United States Patent [19]

Jenkins, Jr. et al.

[11] Patent Number: 4,675,659

[45] Date of Patent: Jun. 23, 1987

[54] METHOD AND APPARATUS FOR SIGNALING ATTEMPTED SUICIDE

[76] Inventors: Dale C. Jenkins, Jr., 918 Broadway, Everett, Mass. 02149; Paul G. King, 80 Swains Pond Ave., Melrose, Mass. 02176

[21] Appl. No.: 828,229

[22] Filed: Feb. 10, 1986

[51] Int. Cl.[4] ..... G08B 23/00; G08B 13/26

[52] U.S. Cl. ..... 340/573; 340/562; 340/666

[58] Field of Search ..... 340/573, 562, 522, 572, 340/825.28, 825.29, 314, 502, 503, 666

[56] References Cited

U.S. PATENT DOCUMENTS 3,764,819 10/1973 Muller ..... 340/573 X 3,925,763 12/1975 Wadhwani et al. ..... 340/573 X 4,228,426 10/1980 Roberts ..... 340/573

4,438,771 3/1984 Friesen et al. ..... 340/573 X 4,551,713 11/1985 Aossey ..... 340/573 X

*Primary Examiner*—Glen R. Swann, III

*Assistant Examiner*—Thomas J. Mullen, Jr.

*Attorney, Agent, or Firm*—Weingarten, Schurgin, Gagnebin & Hayes

[57] ABSTRACT

Means and method are disclosed for providing an alarm signal upon the event of a suicide attempt. All regions at which a confined individual may be located in normal use of a confinement area are sensed for the presence of the individual at the corresponding locations. Absence logic responds to a failure to sense the individual at any of the locations, to signal a possible suicide attempt.

12 Claims, 5 Drawing Figures

METHOD AND APPARATUS FOR SIGNALING ATTEMPTED SUICIDE

FIELD OF THE INVENTION

The instant invention is directed to the field of remote communication, and more particularly, to a novel apparatus and method for signaling attempted suicide.

BACKGROUND OF THE INVENTION

In many circumstances, it is desirable to either voluntarily or involunatrily confine individuals for reasons of public or individual safety, and/or observation. Typical cases include mental institution committals, and either long-term or short-term civil or criminal detention. In part due to the cognitive uncertainties, and in part due to the emotional catharsis, that typically belong to such confinements, the individuals in question often experience, at least for some of the time of their confinement, an impairment of their judgmental capability whereby they contemplate and sometimes pursue an attempt on their own life. In these circumstances, it is desirable to try to prevent suicide attempts, but in the event of the attempt, the continued life of the victim critically depends on the capability to go as quickly to their aid as is humanly possible.

SUMMARY OF THE INVENTION

The present invention is directed towards satisfying the long-felt but heretofore unsatisfied need for a reliable indication of suicide attempt contemporaneously, or nearly contemporaneously, with the attempted suicide, and, as its principal object, contemplates the provision of a fail-safe suicide attempt alarming system and method. It is intended for use in any confined region where individuals may be temporarily or permanently retained, and is particularly useful for mental hospitals, jail-houses, and the like institutions.

In general terms, the method and apparatus for signaling attempted suicide of the present invention contemplates plural sensors, each disposable in a different region of the confinement area, that together provide coverage for every possible location at which a human subject may be located in the confinement area. Any suitable sensor, capable of providing a signal indication of the presence of the individual at the corresponding sensor location, is contemplated.

The apparatus and method for signaling attempted sucide of the present invention further contemplates sensor output signal combining means. While for non-suicidal individuals, the confined subject will always be located somewhere within the confined area, and particularly at a corresponding one of the plural sensor locations, for suicidal individuals, at the moment of their attempted suicide, as by hanging, the subject will not be located at any of the corresponding sensor locations so that all of the plural sensors will fail to provide a signal indication that the subject is located at their corresponding location. The plural sensor output signal combining means in accordance with the present invention contemplates any suitable means operative in response to the absence of all of the plural sensor output signals for providing an attempted suicide signal.

The apparatus and method for signaling attempted suicide of the present invention further contemplates alarming means. The alarming means, which may be either audio, visual or a combination thereof, is operative in response to the possible suicide attempted signal to provide an alert signal, contemporaneous with, or shortly after, the possible suicide attempt. The alert signal allows responsible personnel to respond to the emergency, as soon a it occurs, so that appropriate life-sustaining meansures can be initiated.

In the preferred embodiment, the novel apparatus and method for signaling attempted suicide has exemplary utility in a secure detention facility. In accordance with the preferred embodiment, sensors are mounted respectively to the floor, to the bed-frame, and to the toilet of each jail-cell of a jail-house, these three locations of the jail-cell exhausting the possible locations at which a detainee or prisoner could be located under normal circumstances. Logic circuitry is coupled to the plural sensors for providing a possible suicide attempt signal, representative of the failure of all of the sensors to provide a corresponding sensor output signal, which suicide attempt signal activates an alarm. The alarm provides an emergency alert of a possible suicide attempt. Door-actuated enabling circuitry is disclosed for arming each such jail-cell.

DETAILED DESCRIPTION OF THE PREFERRED EMBODIMENT

Figure 1:
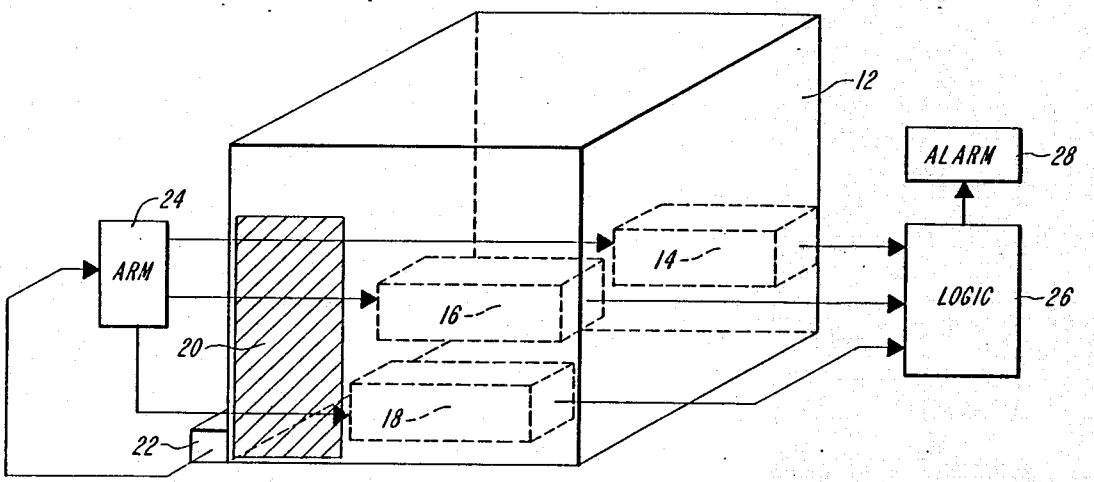
FIG. 1 is a pictorial diagram illustrating the apparatus and method for signaling attempted suicide according to the present invention.

Referring now to FIG. 1, generally designated at 10 is a pictorial view illustrating the apparatus and method for providing a signal indication of a possible suicide according to the present invention. A confinement region, schematically illustrated by a cube 12, represents a jail-cell, a mental-ward, or any other similar place where it is desirable to provide either voluntary or involuntary, permanent or temporary, detention of individuals, it being understood that the present inventio has utility in all such locations.

Plural sensors, schematically illustrated by three dashed boxes 14, 16, 18, are disposed within the confinement region 12 at each and every area thereof where a confined individual, not shown, must be located at any given time under normal conditions. The sensors 14, 16, 18 may be of any type, suitable to provide an output signal indication indicative of the presence of the individual at the corresponding location at which the sensor is positioned within the confinement region 12, and they may be mechanical, electro-mechanical, electrical, and/or optical, electromagnetic, passive or active, without departing from the inventive concept. As will readily be appreciated, the individual, in being located in any intended location of the confinement region 12, is sensed by the corresponding sensor, but, whenever the individual is not so located, as would be the case in the event of self-suspension as by hanging, then none of the sensors would provide a signal representative of the presence of the individual at their corresponding location.

A confinement region door, schematically illustrated in hatched outline 20, is monitored by a sensor 22, such as a jamb-mounted switch, which sensor provides a signal indication of whether the door 20 is in its open condition or not. An arming circuit 24, responsive to the output of the sensor 22, is operative to selectively enable the plural sensors 14, 16, 18 so that, when the door 20 is open, the arming circuit 24 prevents unintended actuation of the several sensors, and therewith forecloses the possibility of false suicide indications, such as would be the case whenever the confinement region 12 is unoccupied. In the closed condition of the door 20, the arming circuit 24 is operative to energize the plural sensors 14, 16, 18.

Logic 26 is coupled to the output of the seveal sensors 14, 16, 18. Any suitable logic 26, operative to provide an output signal in response to the simultaneous failure of the individual sensor output signals from the corresponding sensors 14, 16, 18 can be employed without departing from the inventive concept. The logic 26 may be, for example, either hard-wired in logic gates or software-implemented by micro or other processor controller.

An alarm 28 is coupled to the output of the logic 26, and it is operative in response to the output of the absence logic circuitry 26 to provide a sensible indication of a possible suicide. The alarm may be audio, visual, local, or remote, without departing from the inventive concept.

Figure 2:
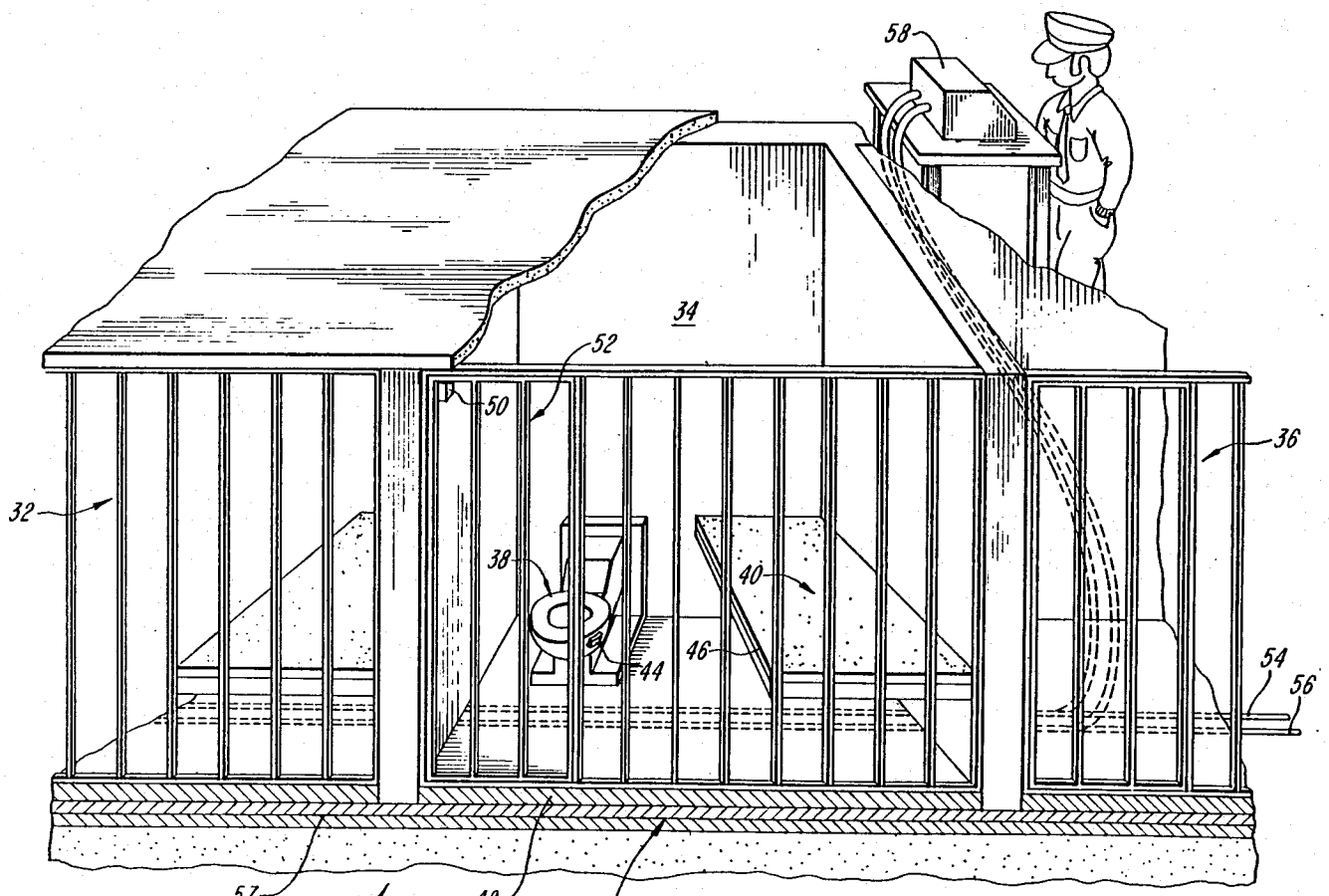
FIG. 2 is a perspective view, partially broken away, of a presently preferred and exemplary embodiment of the apparatus and method for signaling attempted suicide according to the present invention.

Referring now to FIG. 2, generally designated at 30 is a perspective view illustrating a presently preferred embodiment of the apparatus and method for providing a signal indication of a possible suicide in an exemplary jail-house environment. The jail-house 30 includes plural jail-cells, three being illustrated and respectively generally designated 32, 34, 36, each typically being of an identical construction. Each jail-cell 32, 34, 36, as will readily be appreciated, defines a region inhabitable by human individuals, which regions each have an identical, but a precisely limited number, of particular spacial locations at which the confined subjects may be located at any given time under normal conditions. In the typical case, as illustrated, these locations consist of a toilet generally designated 38, a bed generally designated 40, and a floor generally designated 42. The individual confined therein, not shown, must be either at any one of these locations or not be located at any of these locations. Given, then, the fact of confinement of the individual in the jail-cell, and further given no successful jail-break attempt, it will readily be appreciated that the individual could only not be located at either the toilet, bed, or floor locations if and only if the individual is in a suspended condition, out of each of these locations, as would occur only in the event of a possible suicide as by hanging.

Figure 3:
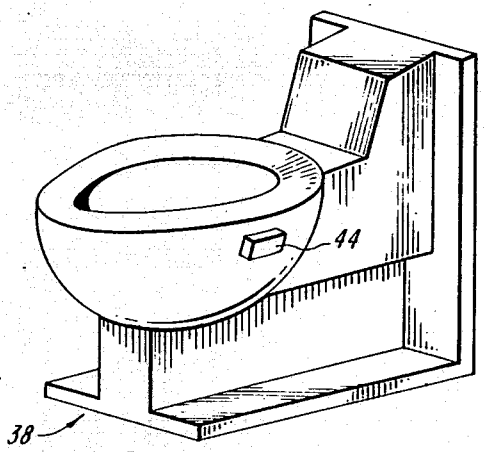
FIG. 3 is a fragmentary perspective view illustrating a portion of one of the sensors of the exemplary and presently preferred embodiment of the apparatus and method for signaling attempted suicide according to the present invention.

A sensor 44 is mounted to the toilet 38 for providing a signal indication of the presence of the individual in and around the region of the toilet. A sensor 46 is mounted to the bed 40 for providing a sensor indication of the presence of the individual on the bed 40, and a sensor 48 is provided on the floor 42 for providing a signal indication of the presence of the individual on and about the floor 42. The sensor 44 preferably includes a capacitive proximity sensor operatively coupled to the bowl of the toilet member 38 as shown in FIG. 3. The floor sensor 48 preferably includes a resilient mat having embedded sheets of spaced contacts 47, 49 operative to mechanically and electrically interconnect at the point or area on the floor at or along which the individual is present thereupon as shown FIGS. 2 and 4. The bed sensor 46, preferably includes a resilient mat of the same construction as the resilient mat provided on the floor 42. The proximity sensor may be of the type commercially available from Sensatron, Inc. of San Diego, Calif., and both the bed sensor and the floor sensor may be of the type commercially available from Tapeswitch Corporation of Farmingdale, N.Y.

A contact switch 50 (FIG. 2) is mounted to a door generally designated 52 of each of the cells 32, 34, 36 to provide a signal indication of whether the associated door is in its open condition or not.

Figure 4:
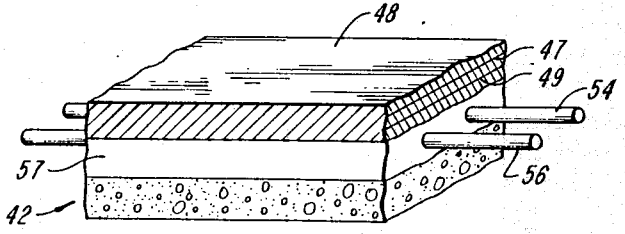
FIG. 4 is a perspective view of another sensor of the exemplary and presently preferred embodiment of the apparatus and method for signaling attempted suicide according to the present invention.

A bus 54 for carrying power to the several sensors 38, 40, 42, and a multiple conductor sensor bus 56, are preferably embedded under the floor sensor 48 in an intermediate floor board 57 shown in FIGS. 2 and 4. The several presence sensors and the door arming sensor, as will readily be appreciated, are operatively connected to the power and signal buses 54, 56 by corresponding electrical wires provided therefor in each of the plural jail-cells of the jail-house.

The power bus 54 and the plural sensor cables 56 are terminated at a control console 58. The console 58 has suitable output alarm devices operative to provide an alarm signal representative of a possible suicide attempt in corresponding jail-cells 32, 34, 36 of the jail-house.

Figure 5:
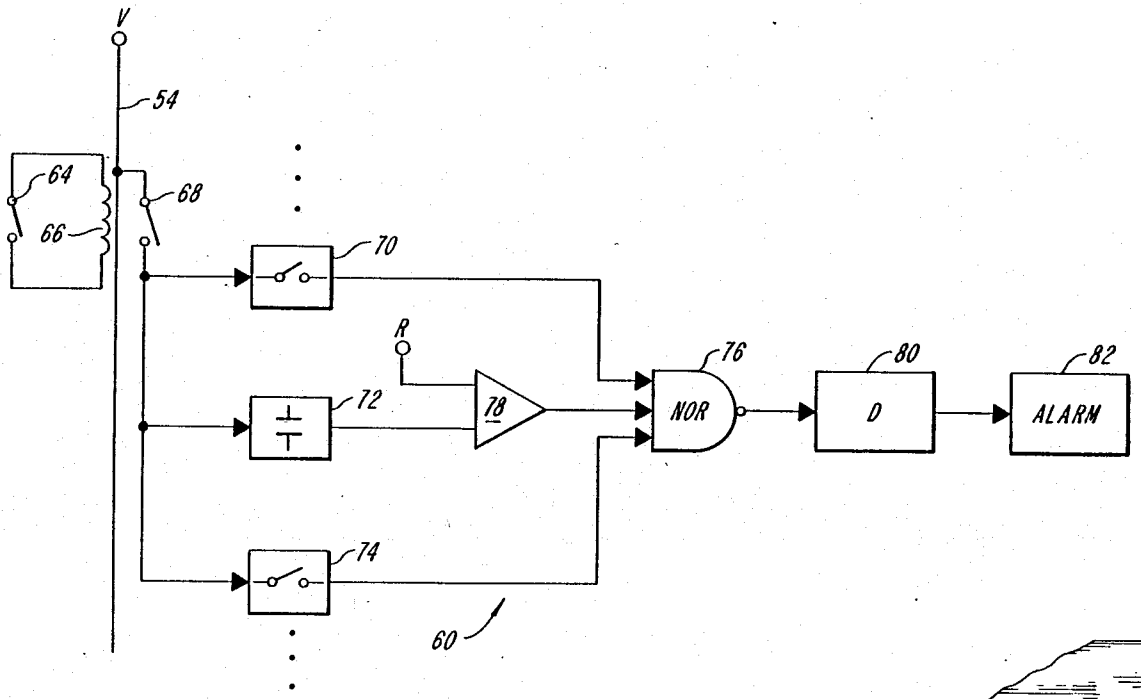
FIG. 5 is a schematic circuit diagram illustrating electronics of the presently preferred and exemplary embodiment of the apparatus and method for signaling attempted suicide according to the present invention.

Referring now to FIG. 5 generally designated at 60 is a schematic diagram illustrating the presently preferred circuitry of the exemplary embodiment of the apparatus and method for providing a signal indication of a possible suicide attempt according to the present invention. The power bus 54 is shown connected to a source of potential designated "V", that extends under the floor sensors the through the several jail cells, as best seen in FIG. 2. A switch 64, operatively mounted to the door of a corresponding jail-cell, is connected in a circuit loop with a coil 66 of a relay. A switch 68, associated with the coil 66, is provided in a circuit path connected to the power bus 54 for each of the jail-cells of the jail-house. A contact-responsive floor mat 70, a capacitive proximity-responsive toilet sensor 72 and a contact-responsive bed sensor 74 are connected through three parallel circuit legs to the output contact of the switch 68 of the relay coil 66. An inverting OR gate 76 is connected to the output of the floor sensor 70, is connected through a comparator 78 to the output of the capacitive proximity toilet sensor 72, and is connected to the output of the contact-responsive bed sensor 74. The other input of the comparator 78 is connected to a source of reference potential designated "R". A delay circuit 80 is connected to the output of the inverting OR 76. An alarm 82 is connected to the output of the delay 80.

In operation, and with the door closed, the circuitry 60 for each jail cell is connected to the power bus 54 through the closed relay switch 68 associated with the corresponding door-sensor, and the presence sensors 70, 72, 74 are therewith actuated and thereby placed in their armed condition. So long as any of the inputs to the inverting OR gate 76 is present, which condition corresponds to the confined individual being present at any one of the locations at which it is possible for the individual to be present, the gate 76 is in its binary "0" state. In the case where all of the outputs of the several sensors 70, 72, 74 are absent, the inverting OR gate 76 is in its binary "1" condition. After the preselected delay imposed by the delay circuit 80 elapses, which delay is selected to prevent unintended attempted suicide signal indications such as would be occasioned when the individual is, for example, exercising, the alarm 82 is actuated. Whereupon, personnel cognizant of the alarm are thereby notified of a possible suicide attempt, and they can make all timely effort to determine whether or not a real suicide attempt has occurred, and, it if has, to take the steps necessary to preserve the life of the individual.

Other suicide attempt signaling systems and methods are contemplated. While in the preferred and exemplary embodiment plural sensors disposed at subject support locations in normal usage of the confinement region are presently preferred, other sensors and alarming systems are contemplated. For example, a horizontal infrared responsive curtain may be provided in the confinement region at a vertical level above, the level of normal usage, and circuitry responsive to the sensed presence of the subject within the horizontal curtain to provide an alarm representative of a possible suicide attempt.

Many modifications of the presently disclosed invention will become apparent to those skilled in the art without departing from the scope of the appended claims.

What is claimed is:

1. A suicide signaling system for a confinement region inhabitable by a human subject that has a limited number of different spacial locations defined in the region at which the human subject may be located at any given time in normal circumstances unless the subject is attempting to hang himself, comprising:

plural sensors, the number of which correspond to the number of said different spacial locations, individually mountable at corresponding ones of said locations for providing plural sensor signals that each have a first identifiable characteristic representative of the presence of the human subject being located at the corresponding location and a second identifiable characteristic different from the first identifiable characteristic representative of said human subject being absent from the corresponding location;

possible suicide attempt signal providing means coupled to said plural sensors and operative in response to said plural sensor signals for providing a possible suicide hanging attempt signal if each of said second characteristics of all of said plural sensor signals occur which indicates that the subject is not present at any of the locations at which the subject may be located in normal circumstances and only if none of said first characteristics of said plural sensor signals occur which indicates that the subject is not attempting to hang himself; and alarming means coupled to said suicide signal providing means and operative in response to said possible suicide hanging attempt signal to provide an alarm signal indicative of a possible suicide attempt if said possible suicide hanging attempt signal meets a predetermined criteria.

2. The invention of claim 1, wherein one of said plural sensors includes a capacitive proximity sensor; wherein said confinement region is a jail-cell, and wherein said proximity sensor is mountable to a toilet found in said jail-cell.

3. The invention of claim 1, wherein one of said plural sensors includes a contact-responsive resilient mat; wherein said confinement region includes a jail-cell, and wherein said resilient contact-responsive mat is mountable to a bed found in said jail-cell.

4. The invention of claim 1, wherein one of said plural sensors includes a resilient contact-responsive floor mat; wherein said confinement region is a jail-cell, and wherein said contact-responsive resilient mat is mountable to a floor of said jail-cell.

5. The invention of claim 1, wherein said possible suicide attempt signal providing means includes logic circuitry.

6. The invention of claim 1, wherein said alarm is an audible alarm.

7. The invention of claim 1, wherein said alarm is a visual alarm.

8. The invention of claim 1, wherein said predetermined criteria is a preselected time duration.

9. A method for signaling possible attempted suicide in a confinement region comprising the steps of:

sensing every sub-region of the confinement region at which a subject confined in the confinement region might be located in the normal use of the confinement region for the presence of the subject at the corresponding sub-region where the subject would be located if the subject was not hanging in the region;

detecting whether sensors is the subject is being sensed at least at one of the corresponding sensed sub-regions at any given time; and signaling a possible suicide hanging attempt in the event that the subject is not being detected at any of the corresponding sensor sub-regions.

10. The invention of claim 9, wherein said sensing step includes the step of placing sensors at and around predetermined support locations defining said subregions in the confinement region.

11. The invention of claim 10, wherein said detecting step includes the step of using electronically-implemented logic to determine whether at least one of said sensors is sensing the presence of the individual at its corresponding location.

12. A suicide signaling system for use in a confinement region comprising:

means for providing a signal representative of whether or not a subject confined within the confinement region is attempting to take his own life by hanging; and means responsive to said signal for providing a sensible alarm indicative of a possible suicide hanging attempt.

* * * * *